US005749203A

United States Patent [19]

McGowan, Jr.

[11] Patent Number: 5,749,203

[45] Date of Patent: May 12, 1998

+

[54] METHOD OF PACKAGING A MEDICAL ARTICLE

[75] Inventor: James Earl McGowan, Jr., Tucson, Ariz.

[73] Assignee: Kimberly-Clark Corporation, Neenah, Wis.

[21] Appl. No.: 311,669

[22] Filed: Sep. 23, 1994

[51] Int. Cl.[6] ..... B65B 31/02

[52] U.S. Cl. ..... 53/432; 53/433; 53/510; 53/511

[58] Field of Search ..... 53/510, 511, 432, 53/433

[56] References Cited

U.S. PATENT DOCUMENTS

| | | | |
|---|---|---|---|
| 3,069,734 | 12/1962 | Leuthner | 21/78 |
| 3,486,295 | 12/1969 | Rausing et al. | 53/167 |
| 3,725,003 | 4/1973 | Moore et al. | 53/433 |
| 3,735,551 | 5/1973 | Pratt | 53/511 |
| 3,830,365 | 8/1974 | Krueger et al. | 53/511 |
| 3,936,270 | 2/1976 | Gunther . | |
| 3,939,287 | 2/1976 | Orwig et al. | 426/316 |
| 3,954,406 | 5/1976 | Chamberlain . | |
| 4,041,203 | 8/1977 | Brock | 428/157 |
| 4,066,399 | 1/1978 | Gunther . | |
| 4,148,933 | 4/1979 | Janovtchik | 53/432 |
| 4,250,143 | 2/1981 | Bryan et al. . | |
| 4,294,804 | 10/1981 | Baran . | |
| 4,329,829 | 5/1982 | Tortertot | 53/426 |
| 4,332,122 | 6/1982 | Williams | 53/425 |
| 4,342,730 | 8/1982 | Perrotta . | |
| 4,372,098 | 2/1983 | Mason | 53/412 |
| 4,622,800 | 11/1986 | Turtschan | 53/425 |
| 4,656,813 | 4/1987 | Baldini et al. | 53/410 |
| 4,673,506 | 6/1987 | Henne et al. . | |
| 4,681,739 | 7/1987 | Rosenblatt et al. . | |
| 4,708,849 | 11/1987 | Mielnik, Jr. et al. . | |
| 4,770,851 | 9/1988 | Joslyn . | |
| 4,777,780 | 10/1988 | Holzwarth | 53/432 |
| 4,954,284 | 9/1990 | Batt et al. . | |
| 5,000,918 | 3/1991 | Mebes . | |
| 5,069,017 | 12/1991 | Fabricius | 53/426 |
| 5,082,636 | 1/1992 | Andersen . | |
| 5,135,715 | 8/1992 | Andersen | 53/434 |
| 5,160,700 | 11/1992 | Anderson et al. . | |
| 5,223,217 | 6/1993 | Frizziero . | |
| 5,271,207 | 12/1993 | Epstein et al. | 53/432 |
| 5,427,738 | 6/1995 | Galloway . | |
| 5,474,738 | 12/1995 | Nichols et al. . | |

FOREIGN PATENT DOCUMENTS

| | | |
|---|---|---|
| 824786 | 5/1975 | Belgium . |
| 0 182 553 | 5/1986 | European Pat. Off. . |
| 1 501 802 | 2/1978 | United Kingdom . |

OTHER PUBLICATIONS

Database WPI, Derwent Publications Ltd., London, WO 9609210 (Kimberly–Clark), Mar. 28, 1996, (Abstract).

Database WPI, Derwent Publications Ltd., London, AU 9535868 (Kimberly Clark), Apr. 9, 1996.

Database WPI, Derwent Publications Ltd., London, CA 1017527 (American Steriliser Co.), Sep. 20, 1977.

Database WPI, Derwent Publications Ltd., London, CA 1033143 (American Steriliser Co.), Jun. 20, 1978.

Database WPI, Derwent Publications Ltd., London, CA 1034341 (American Steriliser Co.), Jul. 11, 1978.

(List continued on next page.)

*Primary Examiner*—John Sipos
*Assistant Examiner*—Gene L. Kim
*Attorney, Agent, or Firm*—David J. Alexander

[57] ABSTRACT

A method for sterilizing an article supported in a housing is provided. The method includes placing an article in a housing, introducing pressurized steam and a sterilizing gas into the housing and closing the housing. The sterilizing gas may be mixture of ethylene oxide/carbon dioxide or ethylene oxide/nitrogen. The percent by volume of ethylene oxide in the housing at the conclusion of the sterilizing gas introducing step may range from at least about 2% to about 25% by volume. The present invention is particularly well suited for use with a form-fill-seal process.

42 Claims, 6 Drawing Sheets

OTHER PUBLICATIONS

Database WPI, Derwent Publications Ltd., London, FR 2672497 (Andersen HW Products), Aug. 14, 1992.
Database WPI, Derwent Publications Ltd., London, CA 2036401 (Andersen HW Products), Aug. 16, 1992.
Database WPI, Derwent Publications Ltd., London, CA 1337144 (Allied–Signal Inc.), Oct. 3, 1995.
Database WPI, Derwent Publications, Ltd., London, JP 93086233, (Johnson & Johnson), Dec. 10, 1993.
Database WPI, Derwent Publications, Ltd., London, DE 3319504, (Akzo), Nov. 29, 1984 (Abstract).
Database WPI, Derwent Publications, Ltd., London, EP 130315, (Akzo), Jan. 9, 1985.
Database WPI, Derwent Publications, Ltd., London, JP 59232555, (Akzo), Dec. 27, 1984.
Database WPI, Derwent Publications, Ltd., London, CA 1213715, (Whatman Reeve Angel), Nov. 12, 1986.
Database WPI, Derwent Publications, Ltd., London, JP 58205522, (Whatman Reeve Angel), Nov. 30, 1983.
Database WPI, Derwent Publications, Ltd., London, GB 2120121, (Whatman Reeve Angel), Nov. 6, 1985.
Database WPI, Derwent Publications, Ltd., London, EP 130315, (Akzo), Oct. 12, 1988.
Database WPI, Derwent Publications, Ltd., London, DE 3474502, (Akzo), Nov. 17, 1988.
Database WPI, Derwent Publications, Ltd., London, DE 3219141, (Whatman Reeve Angel), Nov. 24, 1983.
Database WPI, Derwent Publications, Ltd., London, GB 2120121, (Whatman Reeve Angel), Nov. 30, 1983.
Database WPI, Derwent Publications, Ltd., London, JP 61033659 (Johnson & Johnson), Feb. 17, 1986.
Database WPI, Derwent Publications, Ltd., London, CA 1245034 (Johnson & Johnson), Nov. 22, 1988.
Database WPI, Derwent Publications, Ltd., London, EP 159660 (Johnson & Johnson), Sep. 11, 1991.
Database WPI, Derwent Publications, Ltd., London, DE 3584027, (Johnson & Johnson), Oct. 17, 1991.
Database WPI, Derwent Publications Ltd., London, FI 8504772, (Sanitized Verwertun), Jun. 11, 1986.
Database WPI, Derwent Publications, Ltd., London, ES 8800326 (Sanitized Verwertun), Jan. 1, 1988.
Database WPI, Derwent Publications, Ltd., London, CA 1285767, (Santized Verwertun), Jul. 9, 1991.
Database WPI, Derwent Publications, Ltd., London, EP 159660 (Johnson & Johnson), Oct. 30, 1985 (Abstract).
Database WPI, Derwent Publications Ltd., London, EP 185612 (Sanitized Verwertun), Jun. 25, 1986 (Abstract).
Database WPI, Derwent Publications Ltd., London, JP 61140503 (Sanitized Verwertun), Jun. 27, 1986.
Database WPI, Derwent Publications Ltd., London, NO 8504945 (Sanitized Verwertun), Jul. 7, 1986.
Database WPI, Derwent Publications Ltd., London, DK 8505695 (Sanitized Verwertun), Jun. 11, 1986.
PCT Search Report for PCT/US95/11544 dated Feb. 1, 1996.

METHOD OF PACKAGING A MEDICAL ARTICLE

FIELD OF INVENTION

The present invention is directed to sterilization processes which utilize a sterilizing gas. More particularly, the present invention is directed to sterilant gas sterilization processes for sterilizing surgical articles formed from nonwoven fabrics, such as surgical gowns and drapes.

BACKGROUND OF THE INVENTION

As is generally known, many disposable and reusable surgical articles, and particularly surgical articles formed from a fabric, and more particularly, surgical garments, require sterilization prior to their use in surgery. Such surgical garments include, for example, surgical drapes and surgical clothing, such as surgical gowns. Numerous sterilization processes are available and include, radiation, steam, plasma discharge, and sterilization via sterilizing gas. With regards to sterilization via sterilizing gas, one of the more traditional sterilizing gases used is ethylene oxide. Two well known sterilization processes utilizing ethylene oxide include (i) chamber sterilization and (ii) the Anderson Steri-Jet™ process.

Traditionally, the chamber sterilization process includes four phases: (i) preconditioning, (ii) sterilization (iii) degassing, and (iv) quarantining. In the preconditioning phase, the medical articles to be sterilized are first palletized and then placed in a preconditioning room. The temperature and the humidity in this chamber are set generally between 100° Fahrenheit (F.) to 140° F. and between 40 to 80% relative humidity. These conditions are maintained throughout the preconditioning phase, which may generally take from about 12 to about 72 hours to complete.

The purpose of the preconditioning phase is to elevate the temperature and relative humidity of the palletized articles. At these elevated temperatures, ethylene oxide gas is thought to be more molecularly active and therefore performs more effectively as a sterilizing agent. Additionally, in the presence of higher relative humidity levels, ethylene oxide is thought to flow more freely through packaging compositions and materials used in forming the articles which are undergoing sterilization.

The sterilization phase generally involves transferring the palletized preconditioned articles from the preconditioning room to a sterilization chamber. The size of the sterilization chamber may range from a few cubic feet to 3500 cubic feet or more. The temperature within a sealed sterilization chamber may range from between 100° F. to 140° F. Additionally, some of the gases within the sealed sterilization chamber may be evacuated such that the pressure therein may be between about 300 to about 900 millibars of mercury. By creating a partial vacuum within the sealed sterilization chamber, dilution of the ethylene oxide is reduced as well as the risk of fire by ethylene oxide ignition.

Once under partial vacuum, the relative humidity within the sterilization chamber is maintained between about 30 to 80 percent by the injection of water vapor generally in the form of low pressure steam of less than 15 psi. Following steam injection, to assure the moistening of all the articles within the sealed sterilization chamber, a period of time, generally referred to as a "dwell period", is permitted to lapse.

Once the dwell period has lapsed, a sterilizing gas is introduced into the sterilization chamber. Following the introduction of the sterilizing gas, such as for example, a mixture of ethylene oxide and nitrogen, the pressure level inside the chamber may range from 500 millibars of mercury to 2300 millibars of mercury. The concentration of ethylene oxide within the chamber is generally at least 400 milligrams per liter (mg/l) and may be as high as 1500 mg/l or higher. The duration of exposure to ethylene oxide may be from between 2–12 hours or longer, depending upon several factors, including temperature, pressure, humidity, the specific sterilant mixture being used, and the products being sterilized.

After the articles have been exposed to the sterilizing gas for a sufficient time, the sterilizing gas is evacuated from the chamber by a series of vacuums and air or nitrogen rinses. When ethylene oxide is used, due to its potential flammability in oxygen or air, the chamber is usually rinsed with an inert gas, such as nitrogen.

The degassing phase follows the sterilization phase. Degassing generally involves moving the sterilized, palletized products from the sterilization chamber to a degassing or aeration room. The temperature in the degassing room is generally maintained between 90° F. to 140° F.

In the last phase, the quarantine phase, the articles exiting the degassing room are warehoused in a quarantine area. Samples are removed and tested for sterility. While awaiting sterility verification, additional degassing of the articles may occur. Quarantining and sterility verification may take from 3 to 14 days. As such, generally the traditional chamber sterilization process, excluding quarantine time, may take from between 48 to 72 hours for most surgical articles.

The Anderson Steri-Jet™ process (hereinafter the "Anderson process") is similar to the chamber process, except that the products are processed as individual packages using a Steri-Jet unit rather than a sterilization chamber. The Anderson process includes four phases; preconditioning, sterilizing, degassing and quarantining.

The preconditioning phase includes placing the surgical articles into special pre-formed bags. The surgical articles are preconditioned for a similar time and under similar conditions as the preconditioning phase of the chamber sterilization process described above.

After preconditioning is complete, the bags and contents are positioned in a Steri-Jet unit. The Steri-Jet unit is a bar type package heat sealer with retractable fins. The fins are inserted into the bag between the upper and lower seal bars prior to sealing the bag closed. The retractable fins are inserted into the open end of the bag. Next, the seal bars close the open end of the bag around the fins. The closed bags are evacuated by removing some of the air therein through channels in the retractable fins such that the pressure inside the closed bags is generally between about 500 to about 700 millibars of mercury. After the evacuation step is completed, 100% ethylene oxide is injected into the bag via the fin channels. Following ethylene oxide injection, the fins are retracted and the bag is closed. Generally, the concentration of ethylene oxide within each of these bags at the conclusion of the injection of ethylene oxide is from about 400 mg/l to about 1500 mg/l.

The closed bags are then placed in a degassing area. In this way, sterilization and degassing occur simultaneously in the degassing room. Following degassing, the bags are moved to a quarantine area for sterility verification. The Anderson process, excluding the quarantining phase, may take from between 36 to 48 hours.

While the above described process are effective for sterilizing surgical articles, both processes have several drawbacks. One such drawback in is the length of time required for each of these processes. Another drawback is the concentration of ethylene oxide used during the sterilization phases. At these concentrations of ethylene oxide, generally from between about 400 mg/l to about 1500 mg/l, safety concerns stemming from both toxicity as well as flammability issues are ever present.

Therefore, there is a need for an ethylene oxide sterilization process which is capable of sterilizing a surgical article in less time. There is also a need for an ethylene oxide sterilization process with reduced risk of toxicity and flammability. Such an improved ethylene oxide sterilization process is provided by the present invention and will become more apparent upon further review of the following specification and claims.

SUMMARY OF THE INVENTION

In response to the above problems encountered by those of skill in the art, the present invention provides a process for sterilizing an article in less time than conventional sterilization processes. Furthermore, several embodiments of the present invention further provide a sterilization process with reduced risks of fire by sterilant gas ignition.

The sterilization process of the present invention utilizes a sterilizing gas, such as for example ethylene oxide. This process includes positioning an article to be sterilized in a housing. In one embodiment, a suitable housing may be formed by a top and a bottom web suitable for use in a form-fill-and seal process. It is also desirable that the web forming material be sufficiently permeable to the sterilizing gas while at the same time being sufficiently impermeable to contaminates. In this way, the desired concentration of sterilizing gas may be maintained within the housing for a sufficient period of time to effectuate sterilization of the article while permitting a sufficient amount of sterilizing gas within a reasonable period to de-gas or defuse through the web forming material to the exterior of the housing.

In the case of the form-fill-seal process, the article to be sterilized is placed in a housing defined by a bottom preformed web sized for supporting the article to be sterilized and a top web overlying the article and the preformed bottom web. A ported nozzle is positioned between the top and bottom webs for selective movement of gases into and out of the housing. Upon the evacuation of at least some of the air from the housing via the ported nozzle, steam is introduced into the housing through the ported nozzle. In one embodiment, the pressure of the steam at the ported nozzle is between about at least 15 to about 80 pounds per square inch (psi) and particularly between about 45 to about 60 psi. Steam is introduced until the pressure within the housing is between about 40 to about 100 millibars of mercury.

After the housing is sufficiently pressurized by the steam, a sterilizing gas is introduced via the ported nozzle into the housing. In one embodiment, a quantity of substantially pure sterilizing gas may be introduced into the housing until the pressure therein is between about 300 to about 700 millibars of mercury. When ethylene oxide is the sterilizing gas, the percent by volume of ethylene oxide present in the housing at the conclusion of the sterilizing gas introducing step may range from about 2% to about 50%, and particularly between about 3% to about 25% and more particularly, between about 5% to about 10% and still more particularly, between about 6% to about 8%.

In another embodiment, the sterilizing gas may be a mixture of ethylene oxide and a carrier gas or gases. In one embodiment, the carrier gas may be nitrogen. In another embodiment, the carrier gas may be carbon dioxide. Ethylene oxide and carrier gas are introduced into the housing until the pressure within the housing is between about 300 to about 700 millibars of mercury. Upon sufficient pressurization of the housing, the ported nozzle is removed and the contacting portions of the top and bottom webs, respectively, are sealed together by any conventional sealing process, such as by heat sealing, thus closing the housing. When the sterilizing gas introduced into the housing is a mixture of ethylene oxide and a carrier gas, the percent of ethylene oxide by volume within the housing at the conclusion of the sterilizing gas introducing step may range from about 2% to about 25% and more particularly between about 5% to about 10% and still more particularly between about 6% to about 8%.

The closed housing is then conveyed to a degassing area. The temperature in this area may range from about 70° F. to about 160° F. The closed housing is maintained in this area for a sufficient time, generally at least about 4 hours, to permit degassing of the housing.

Upon degassing, the housing is conveyed to a quarantine area for sterility verification. With the exception of the quarantining step, the combination of the form-fill-seal process and degassing are generally completed in less than about 18 hours which is considerably less time than the 36 to 72 hours required for conventional sterilization processes.

DETAILED DESCRIPTION OF THE INVENTION

Figure 1:
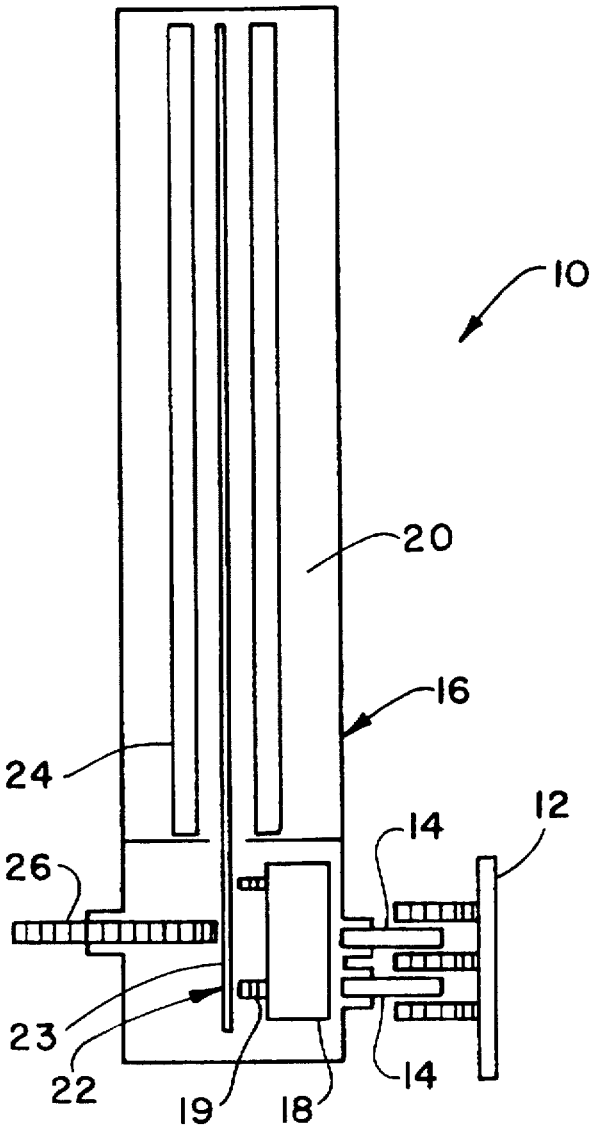
FIG. 1 is a top plan schematic view of a sterilizing gas sterilization plant.

Turning now to the drawings and referring first to FIG. 1, a sterilizing gas sterilization plant 10 is schematically illustrated. The plant 10 includes a conveyor system 12 for supplying un-sterilized articles (not shown) to a pair of form-fill-and seal (hereafter "FFS") machines 14. As described in greater detail below, the sterilizing gas is provided directly to the FFS machine. Upon the capture of an article to be sterilized in a housing formed within the FFS machine 14, steam and sterilizing gas are introduced into the housing. After the introduction of a sufficient amount of steam and sterilizing gas, the housing is closed.

The introduction of both steam and sterilizing gas and the closing of the housings may occur in a sealed area 16. Within the sealed area 16, individual housings are case-packed and palletized in a case packing area 18. The palletized housings are conveyed, by a conveyor system 19, to a degassing area 20 by an automated storage and retrieval system (hereafter "ASRS") 22. The ASRS 22 includes a conveyor 23 and storage racks 24. The temperature within the sealed area 16 and particularly the degassing area 20 may be maintained at about 70° F. to about 160° F. and particularly from about 90° F. to about 150° F. and more particularly from about 120° F. to about 140° F. The temperature within the sealed area may be maintained above 160° F. provided the article being sterilized and the materials forming the housing are compatible with the elevated temperature. The palletized housings remain in the degassing area 20 for a sufficient time to effect degassing. This period of time is generally at least about 4 hours and particularly from at least about 4 hours to about 18 hours.

After sufficient time has elapsed, the palletized housings are removed from the sealed area 16 by a conveyor system 26. Once removed from the sealed area 16, the palletized housings are staged in a quarantine area (not shown) until tested to verify the sterility of the article and to measure the levels of residual sterilizing gas present, if any. Upon satisfactorily meeting these tests and verifications, the packaged articles are suitable for distribution.

Un-sterilized articles suitable for use in the present invention include those articles which are capable of being captured within a housing and more particularly, captured within a housing formed by a FFS machine and are compatible with the sterilizing gas. More particularly, such articles include both disposable and reusable surgical articles. And still more particularly, such articles include surgical articles formed from polymeric materials. And still more particularly, surgical articles, such as for example, surgical garments and draping, which are formed from polymeric fabrics.

As used herein, the term "polymeric material" means a synthetic or natural polymeric material, although the former are more likely to be employed in the present invention. As used herein, the term "polymeric fabric" means a fabric prepared from any polymeric material capable of being formed into a fabric.

Examples of natural polymeric materials include, cotton, rubber, silk, wool, and cellulose, by way of illustration only. Synthetic polymeric materials, in turn, can be either thermosetting or thermoplastic materials, with thermoplastic materials being more common. Examples of thermosetting polymers include, by way of illustration only, alkyd resins, such as phthalic anhydride-glycerol resins, maleic acid-glycerol resins, adipic acid-glycerol resins, and phthalic anhydride-pentaerythritol resins; allylic resins, in which such monomers as diallyl phthalate, diallyl isophthalate diallyl maleate, and diallyl chlorendate serve as nonvolatile cross-linking agents in polyester compounds; amino resins, such as aniline-formaldehyde resins, ethylene urea-formaldehyde resins, dicyandiamide-formaldehyde resins, melamine-formaldehyde resins, sulfonamide-formaldehyde resins, and urea-formaldehyde resins; epoxy resins, such as crosslinked epichlorohydrin-bisphenol A resins; phenolic resins, such as phenol-formaldehyde resins, including Novolacs and resols; and thermosetting polyesters, silicones, and urethanes.

Examples of thermoplastic polymers include, by way of illustration only, end-capped polyacetals, such as poly(oxymethylene) orpolyformaldehyde, poly(trichloroacetaldehyde), poly(n-valeraldehyde), poly(acetaldehyde), poly(propionaldehyde), and the like; acrylic polymers, such as polyacrylamide, poly(acrylic acid), poly(methacrylic acid), poly(ethyl acrylate), poly(methyl methacrylate), and the like; fluorocarbon polymers, such as poly(tetrafluoroethylene), perfluorinated ethylene-propylene copolymers, ethylene-tetrafluoroethylene copolymers, poly(chlorotrifluoroethylene), ethylene-chlorotrifluoroethylene copolymers, poly(vinylidene fluoride), poly(vinyl fluoride), and the like; polyamides, such as poly(6-aminocaproic acid) or poly(ε-caprolactam), poly(hexamethylene adipamide), poly(hexamethylene sebacamide), poly(11-aminoundecanoic acid), and the like; polyaramides, such as poly(imino-1,3-phenyleneiminoisophthaloyl) or poly(m-phenylene isophthalamide), and the like; parylenes, such as poly-p-xylylene, poly(chloro-p-xylylene), and the like; polyaryl ethers, such as poly(oxy-2,6-dimethyl-1,4-phenylene) or poly(p-phenylene oxide), and the like; polyaryl sulfones, such as poly(oxy-1,4-phenylenesulfonyl-1,4-phenyleneoxy-1,4-phenylene-isopropylidene-1,4-phenylene), poly(sulfonyl-1,4-phenyleneoxy-1,4-phenylenesulfonyl-4,4'-biphenylene), and the like; polycarbonates, such as poly(bisphenol A) or poly(carbonyldioxy-1,4-phenyleneisopropylidene-1,4-phenylene), and the like; polyesters, such as poly(ethylene terephthalate), poly(tetramethylene terephthalate), poly(cyclohexylene-1,4-dimethylene terephthalate) or poly(oxymethylene-1,4-cyclohexylenemethyleneoxyterephthaloyl), and the like; polyaryl sulfides, such as poly(p-phenylene sulfide) or poly(thio-1,4-phenylene), and the like; polyimides, such as poly(pyromellitimido-1,4-phenylene), and the like; polyolefins, such as polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), poly(vinylidene chloride), polystyrene, and the like; copolymers of the foregoing, such as acrylonitrile-butadiene-styrene (ABS) copolymers, and the like; and the like. In certain embodiments, the polymeric fabric will be prepared from a polyolefin. In other embodiments, the polyolefin will be polypropylene.

The term "fabric" is used broadly herein to mean any fibrous material which has been formed into a sheet or web. That is, the fabric is composed, at least in part, of fibers of any length. Thus, the fabric can be a woven or nonwoven sheet or web, all of which are readily prepared by methods well-known to those having ordinary skill in the art. For example, nonwoven webs are prepared by such processes as meltblowing, coforming, spunbonding, carding, air laying, and wet laying. Moreover, the fabric can consist of a single layer or multiple layers. In addition, a multilayered fabric can include films, scrim, and other non-fibrous materials.

It has been found that nonwoven webs formed from polyolefin-based fibers are particularly well-suited for use in the present invention. Examples of such nonwoven webs are the polypropylene nonwovens produced by the Assignee of record, Kimberly-Clark Corporation. One such multiple-layered nonwoven web, a spunbond, meltblown, spunbond (SMS) nonwoven web, is produced by Kimberly-Clark Corporation.

This spunbond, meltblown, spunbond fabric may be made from three separate layers which are laminated to one another. Such a method of making this laminated fabric is described in commonly assigned U.S. Pat. No. 4,041,203 to Brock et al which is incorporated herein in its entirety by reference. Alternatively, the spunbond, meltblown, spunbond fabric may be made by first forming a spunbond-meltblown laminate. The spunbond-meltblown laminate is formed by applying a layer of meltblown onto a layer of spunbond. The second layer of spunbond is then applied to the meltblown side of the previously formed spunbond-meltblown laminate. Generally, the two outer layers provide the nonwoven fabric with strength while the inner layer provides barrier properties. Including the above described SMS nonwoven web, other nonwoven webs as well as other materials including wovens, films, foam/film laminates and combinations thereof may be used to construct fabrics which are well suited for use in the present invention.

Suitable sterilizing gases are those gases which are at least compatible with the un-sterilized article and the processing parameters, such as temperature and pressure and, when present in sufficient quantity, can effectuate the sterilization of the article over a period of time. In one embodiment, the sterilizing gas is a mixture of a carrier gas and a sterilizing gas. Carrier gases are those gases which are, at the least, compatible with both the sterilizing gas or gases and the article being sterilized. Examples of sterilizing gases include, but are not limited to, ethylene oxide, ozone, hydrogen peroxide vapor and plasma. Examples of carrier gases include, but are not limited to, nitrogen, carbon dioxide and freon. When the sterilizing gas includes a mixture of ethylene oxide and either nitrogen or carbon dioxide, the percent by volume of ethylene oxide present therein may generally be at least about 2%, and more particularly, from about 3% to about 25% and still more particularly, from about 5% to about 10% and still more particularly, from about 6% to about 8%.

Figure 2:
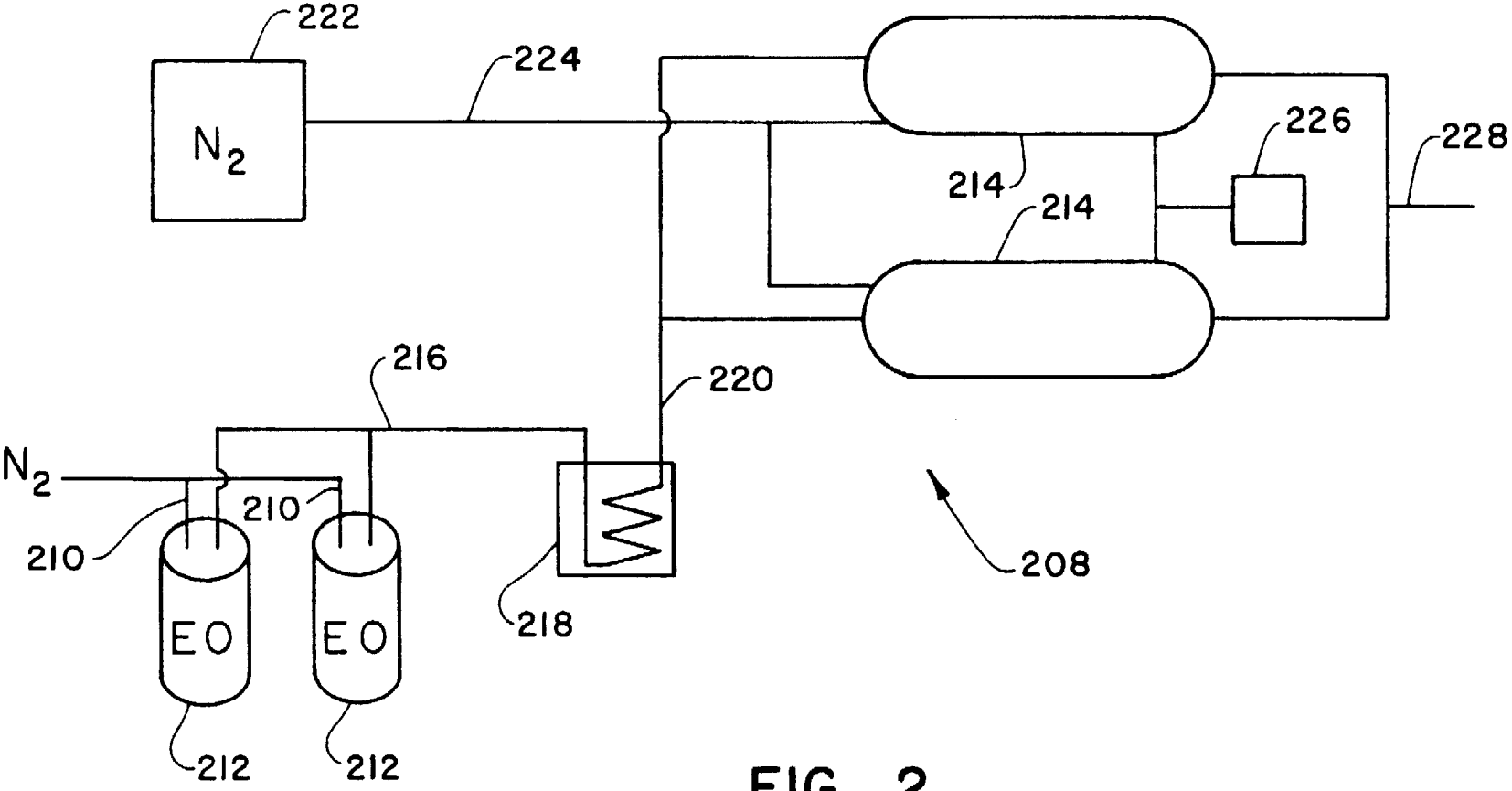
FIG. 2 is a schematic view of an ethylene oxide/nitrogen batch mixing system.
Figure 3:
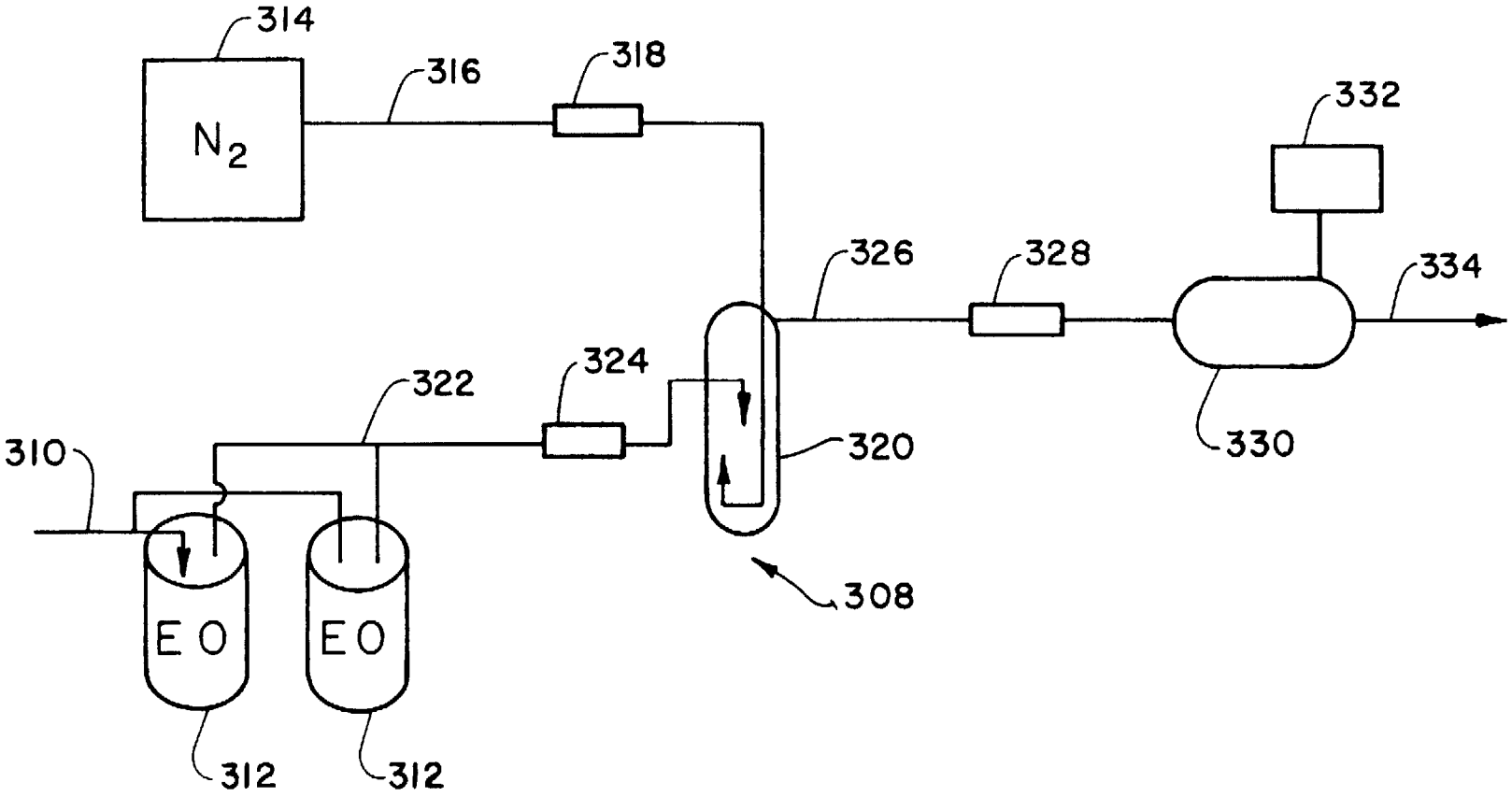
FIG. 3 is a schematic view of an ethylene oxide/nitrogen continuous mixing system.

Suitable gas mixing systems for mixing ethylene oxide with either nitrogen or carbon dioxide are illustrated in FIGS. 2 and 3. These systems include both batch and continuous feed processes. An example of a batch mixing system 208 for mixing ethylene oxide and nitrogen is illustrated in FIG. 2. The batch mixing system 208 includes a nitrogen gas feeder 210, which is ported to a pair of liquid ethylene oxide sources 212. The gas feeder 210 assists in maintaining the pressure in the ethylene oxide sources 212 by providing pressurized nitrogen gas, generally at around 70 psi, to the ethylene oxide sources 212. Additionally, the nitrogen gas above the liquid ethylene oxide assists in reducing the possibility of ethylene oxide ignition in the ethylene oxide sources 212.

The liquid ethylene oxide sources 212 are connected via a conduit network, described in greater detail below, to a pair of mixing tanks 214. Liquid ethylene oxide is conveyed from the sources 212 via a conduit 216 to a vaporizer or heat exchanger 218. The heat exchanger 218 converts the liquid ethylene oxide into gaseous ethylene oxide. Gaseous ethylene oxide is conveyed from the exchanger 218 via conduit 220 to mixing tanks 214. Nitrogen gas from a nitrogen gas source 222, such as a nitrogen membrane system, is conveyed to the mixing tanks 214 via a conduit 224. The concentration of ethylene oxide is monitored and controlled by an automated control system (not shown) which includes valving, computer hardware, and software, all of which are well known to those skilled in the art. Output from a gas analyzer 226, such as an infrared analyzer, which is connected to the mixing tanks 214 provides input to the automated control system. From the mixing tanks 214, the gas mixture is transferred to the FFS machines via a conduit 228.

An example of a continuous gas mixing system 308 is illustrated in FIG. 3 and includes a nitrogen source 314, which may provide liquid or gaseous nitrogen, and a nitrogen gas feeder 310 ported to a pair of liquid ethylene oxide sources 312. Nitrogen gas from the nitrogen source 314, such as for example a cryogenic nitrogen source (a liquid nitrogen source) or a nitrogen membrane source (a gaseous nitrogen source), passes via conduit 316 to a heat exchanger 318. From the heat exchanger 318, the nitrogen enters a thermally controlled processing tank 320. Liquid ethylene oxide from the ethylene oxide source 312 passes via conduit 322 through a heat exchanger 324 and enters the processing tank 320 as a liquid. Within the processing tank 320, gaseous nitrogen bubbles up through the liquid ethylene oxide. By controlling the temperature and pressure of the vapor (a mixture of ethylene oxide and nitrogen) in the top portion of the tank 320, the percentage of ethylene oxide and nitrogen in the vapor exiting the processing tank 320 via conduit 326 may be controlled. This gas mixture is conveyed via a conduit 326 through another heat exchanger 328 and ultimately to a surge tank 330. Once in the surge tank 330, the gas may be analyzed by a gas analyzer 332, such as an infrared analyzer. Data from the gas analyzer 332 may be input to an automated control system (not shown) similar to the one described above for controlling the blend of gases in the gas mixture. From the surge tank 330, the gas mixture is transferred via conduit 334 to the FFS machines.

Another example of a sterilizing gas mixture suitable for use in the present invention is an ethylene oxide/carbon dioxide mixture. Ethylene oxide/carbon dioxide mixtures may be pre-blended and the pre-blended gases conveyed directly to the FFS machine for injection into the FFS housings. When pre-blended, the percent by volume of carbon dioxide to ethylene oxide is about 91.5% carbon dioxide and about 8.5% ethylene oxide. At these concentrations, the pre-blended mixture of ethylene oxide/carbon dioxide is generally considered non-flammable. As such, the pre-blended ethylene oxide/carbon dioxide mixture provides a non flammable, continuous gas flow alternative to other ethylene oxide blending processes which require the storage and handling of concentrated ethylene oxide.

In one embodiment (not illustrated), the pre-blended ethylene oxide/carbon dioxide may be liquified. Cylinders of such a liquified blend may be linked together via a manifold. The liquified blend would be passed through a volatilizer and the resultant gas blend stored in a holding tank. The gaseous blend may then be conveyed from the holding tank to the FFS machine. Generally, the pressure of the gaseous blend at the FFS machine should be at least about 20 psi and particularly between about 40 to about 45 psi. In some instances, due to the Joule-Thomson coefficient of carbon dioxide, the application of heat to the gas conduit as the gas leaves the holding tank may be required.

The plant 10 may further include an ethylene oxide eliminator system (not shown). Such systems are well known to those skilled in the art. The ethylene oxide eliminator system functions to control or eliminate ethylene oxide emission into the atmosphere. Such systems generally use catalytic oxidation technology to convert ethylene oxide into carbon dioxide and water vapor. One such ethylene oxide eliminator system, the ETO-Abator™, is available from the Donaldson Company, Inc. of Minneapolis, Minn.

With reference now to FIGS. 4A–4F, a sealing chamber or sealing station 410 is illustrated. The sealing station 410 is one of many stations in the FFS process line of the present invention. Examples of other stations and systems (not shown) in the FFS process line include bottom and top web stations, an article dispensing station, a conveyor system, and a casing and/or palletizing station.

Figure 4A:
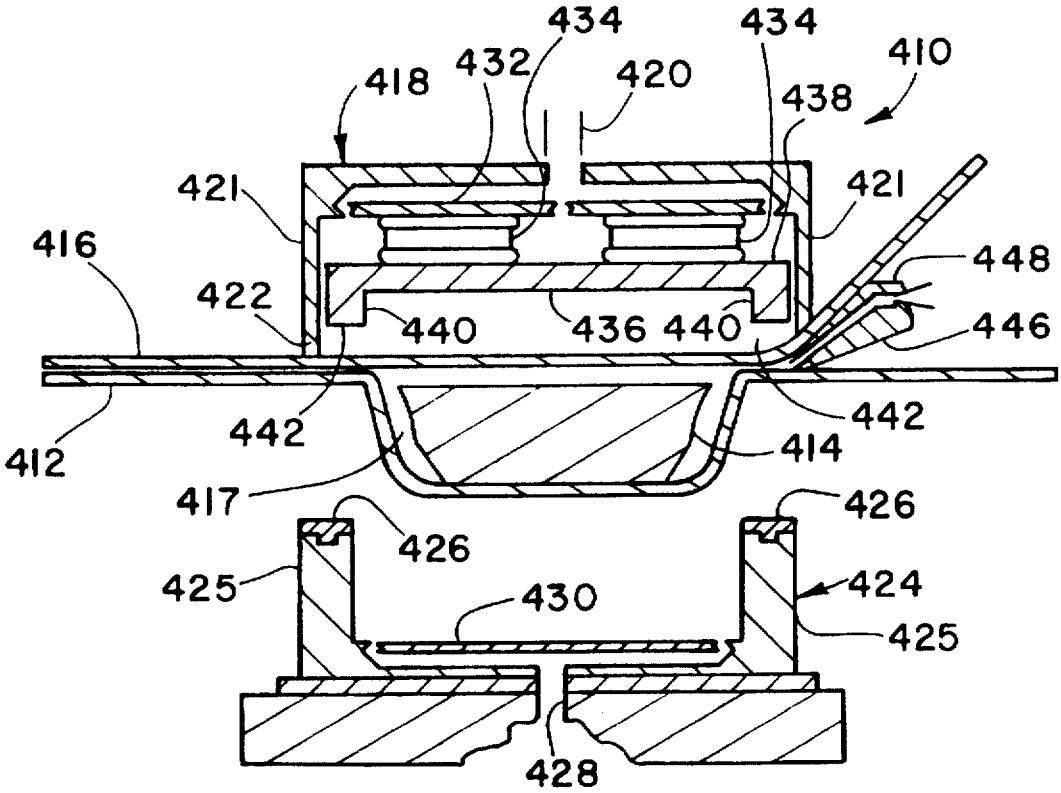
FIGS. 4A–4F are cross sectional views of a sealing station illustrating various stages of the sealing process.

The bottom web station softens and sufficiently molds the bottom web 412 for receiving an article 414 (FIG. 4A). The top web station (not shown) orients a top web 416 (FIG. 4A) with respect to the bottom web 412. The top web station may also print or otherwise attach informational or instructive literature to the top web 416. The orientation of the top web 416 and bottom web 412 within the sealing chamber forms a housing 417 (FIG. 4A).

The top and bottom webs, 416 and 412, may be formed from a variety of materials. Examples of materials suitable for forming the top web include, but are not limited to, paper and paper polyolefin film laminates, plastic, polyolefin films, polyethylene films, high density polyethylene films and high density polyethylene film laminates, nylon 66, and polyolefin nonwoven fibers. Examples of materials suitable for forming the bottom web include, but are not limited to co-extruded ethylene-vinyl acetate, ethylene-vinyl acetate, ethylene-vinyl acetate laminates, particularly an ethylene-vinyl acetate/ionomer resin/ethylene-vinyl acetate laminate and polyethylene film. Ionomer resins are also know by the trademark SURLYN®.

It is desirable that the top and bottom web forming materials be suitable for the bonding or fusing together portions thereof by a heating source, such as a heat bar or other conventional bonding or fusing sources. Furthermore, it is desirable that the material forming the top web 416 and/or the bottom web 412 be so formed so as to permit sufficient quantities of the sterilizing gas or gases introduced into the housing 417 to pass therethrough (degas). In this way, upon completion of the sterilization process, the sterilized articles may be removed from the housing 417 without hazard or risk from residual levels of the sterilizing gas or gases. It is further desirable that upon closing the housing 417, such as by bonding or fusing portions of the top and bottom webs, 416 and 412, respectively, both the top web 416 and the bottom web 412 be sufficiently impermeable to contaminating agents such as bacteria, viruses, dirt, fluids and the like.

The article dispensing station 410 properly places the articles 414 to be sterilized in the formed bottom web 412. The conveyer system properly places and indexes the webs along the form-fill-and seal processing line. The casing station places a pre-determined number of closed housing exiting the sealing station 410 into a package. The palletizing station places a pre-determined number of packages on a pallet.

Figure 4B:
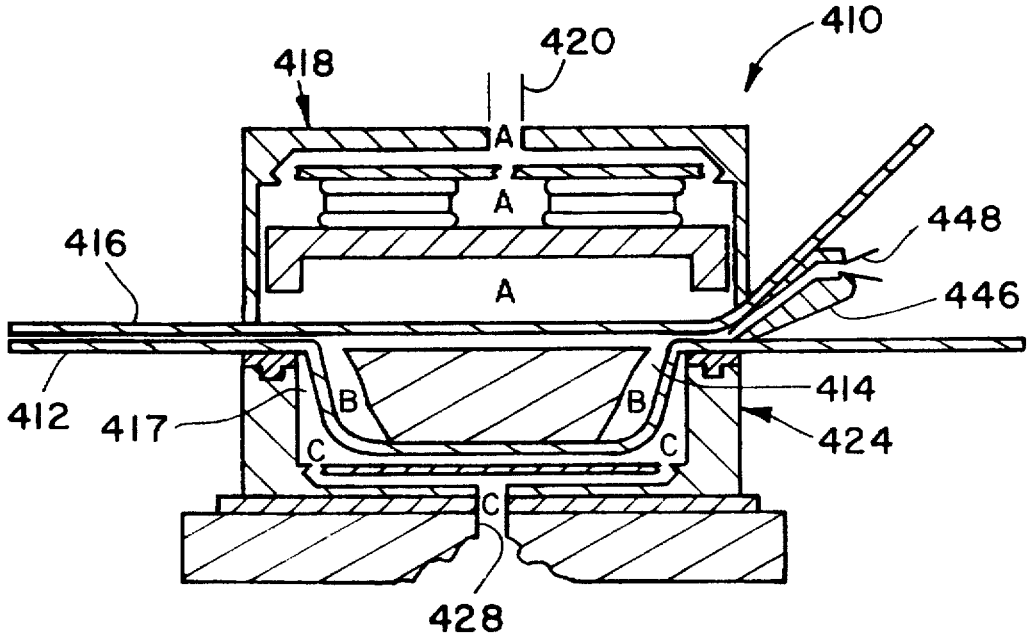
Figure 4C:
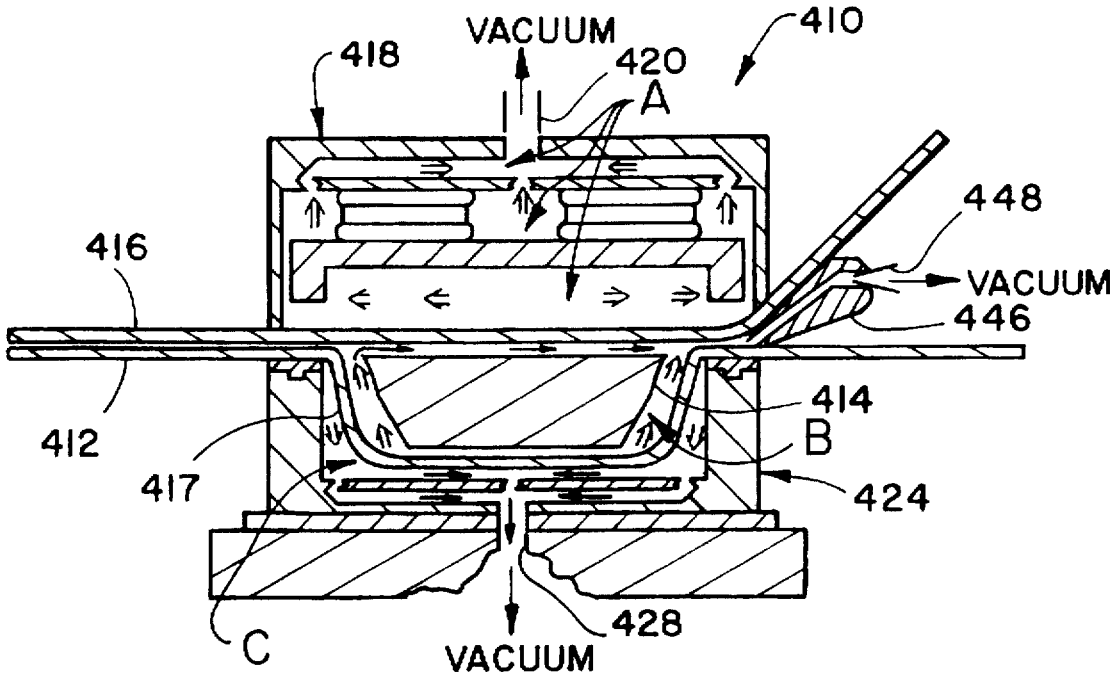
Figure 4D:
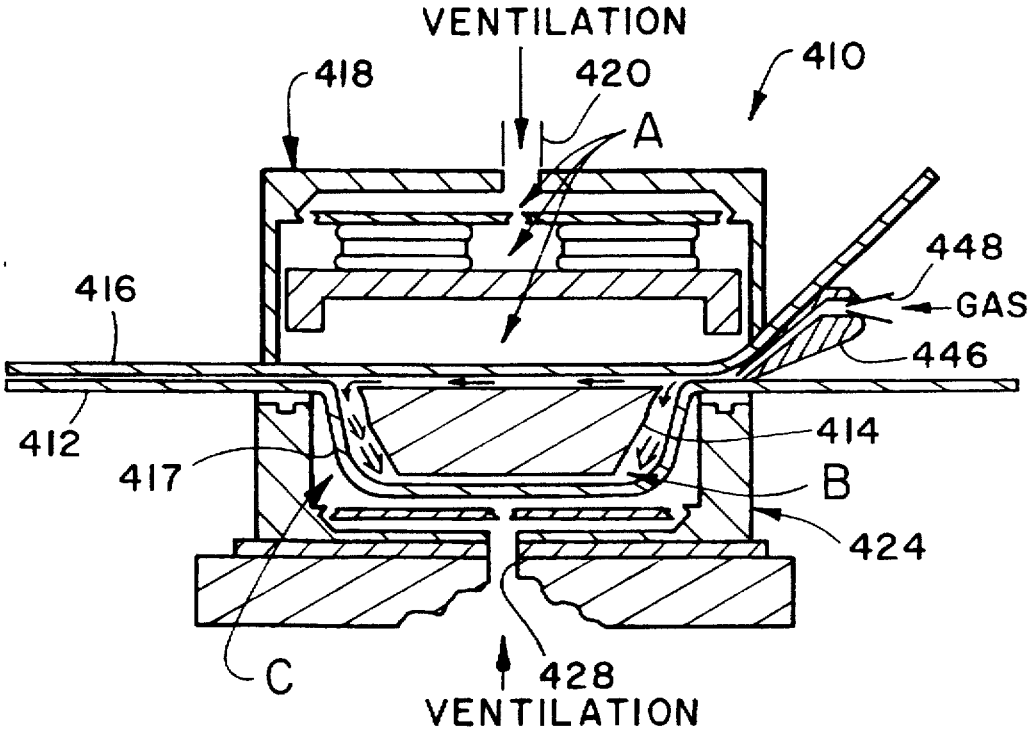
Figure 4E:
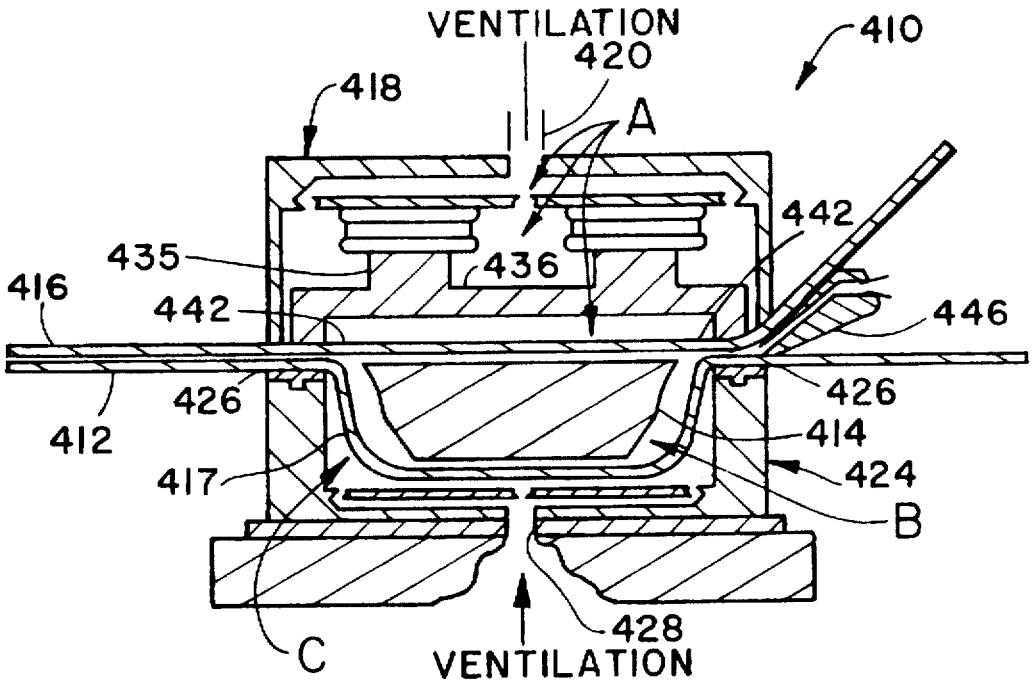

There are several events which sequentially occur within the sealing station 410. These events include an evacuation sequence, a gas introduction sequence, and a sealing sequence. As described in greater detail below, FIGS. 4A–4C illustrate the evacuation sequence, FIG. 4D illustrates the gas introduction sequence and FIG. 4E illustrates the sealing sequence.

Referring now to FIG. 4A, the sealing station 410 includes a lid 418 having a gas port 420, and downwardly extending side walls 421. The lower most portion of the side walls 421 is provided with a continuous lip 422 for engaging the upper surface of the top web 416.

A vertically adjustable seal die 424 includes upwardly extending side walls 425 having a continuous seal 426 secured to the upper most portion the side walls 425. The seal die further includes a gas port 428 and an apertured platform 430. The lid 418 and seal die 424 are dimensioned such that a portion of the lip 422 overlies a portion of the T-rubber 426.

Secured to an apertured platform 432 within the lid 418 is a pair of cylinders 434, each including a piston 435 (FIG. 4E) which is adapted for vertical movement. The upper end of each cylinder 434 is secured to the platform 432. A heat sealer 436, having a horizontal surface 438 and downwardly extending side walls 440, is secured along the surface 438 to each of the pistons 435. The lower most portion of the side walls 440 is provided with a lip 442. The lip 442 of the heat sealer 436 and the seal die 424 are dimensioned such that a portion of the lip 442 overlies a portion of the T-rubber 426.

The sealing station 410 further includes a retractable gas nozzle 446. The gas nozzle 446 is provided with a port 448. The gas nozzle 446 is positioned between the top and bottom webs, 416 and 412, respectively, such that at least some of the gases within the housing 417 may be evacuated and sterilizing gas from a sterilizing gas supply, described above, may be conveyed via the nozzle 446 into the housing 417.

The evacuation process begins with positioning a formed bottom web 412 which supports the article 414 and the top web 416 within the sealing chamber 410 as illustrated in FIG. 4A. At this point, the top and bottom webs, 416 and 412, respectively, are in loose contact. The nozzle 446 is inserted between the top and bottom webs, 416 and 412, respectively.

In the next sequence of the evacuation process, illustrated in FIG. 4B, the seal die 424 is elevated so as to contact and compress portions of the top and bottom webs, 416 and 412, respectively, against each other. Elevation of the seal die 424 also captures the tip portion of the gas nozzle 446 between the top and bottom webs, 416 and 412, respectively. A seal between the top and bottom webs, 416 and 412, respectively, is created by the respective forces exerted by the seal die 424 and the lid 418 against the bottom and top webs, 412 and 416, respectively. In this sealing chamber configuration, the housing is partially closed. The bottom and top webs, 412 and 416, respectively are in compressive contact but are not secured or fused together and the port 448 provides a means for the selective movement of gases into and out of the housing 417.

In addition to partially closing the housing 417, elevation by the seal die 424 in this sequence creates three separate chambers within the sealing station 410. These three chambers are illustrated by the letters A, B and C in FIG. 4B. The chamber A is defined by the interior area of the lid 418 and the upper surface of the top web 416. The gas port 420 provides a means for selectively communicating gases into and out of the chamber A. The chamber B is defined by the interior of the housing 417. The port 448 provides a means for the selective movement of gases into and out of the chamber B via nozzle 446. The chamber C is defined by the interior area of the seal die 424 and the lower surface of the bottom web 412. The port 428 provides a means for the selective movement of gases into and out of the chamber C.

FIG. 4C illustrates the final sequence in the evacuation process. The arrows illustrate the movement of gases within the chambers A, B and C. In this sequence, a partial vacuum is created, through an appropriate valving and pump configuration (not shown), in the chambers A, B and C. Generally, the pressure within the three chambers, A, B and C, may be reduced to between about 30 to about 100 millibars of mercury. In this way, a portion of the air in chamber B and the article 414 may be removed via the port 448.

FIG. 4D illustrates the gas introduction sequence. The vacuum is removed from chambers A and C. Chambers A and C are ventilated via gas ports 420 and 428, respectively. During the ventilation of chambers A and C, or shortly thereafter, gases are introduced into chamber B via port 448.

In one embodiment, one of the gases introduced into chamber B is steam. The steam pressure at the nozzle 446 may be between about 15 to about 80 psi and more particularly between about 45 to about 60 psi. Another gas introduced into chamber B is the sterilizing gas, described above. The steam and the sterilizing gas may be introduced into chamber B sequentially or simultaneously. When the steam and sterilizing gas are introduced sequentially, the steam may be introduced first followed by the sterilizing gas. In this case, the steam is introduced into the chamber B until the pressure in the chamber B measures between about 40 to about 100 millibars of mercury. After the supply of steam is removed, the sterilizing gas is introduced into the chamber B until the pressure in the chamber B measures between about 300 to about 700 millibars of mercury. When the sterilizing gas is introduced first followed by the steam, the sterilizing gas may be introduced into chamber B until the pressure in the chamber B measures between about 290 to about 630 millibars of mercury. Steam may then be introduced into chamber B until the pressure in the chamber B is at least between about 300 to 700 millibars. When the steam and sterilizing gas are introduced simultaneously into the chamber B, these gases are introduced into the chamber B until the pressure therein is between about 300 to about 700 millibars of mercury.

When the sterilizing gas introduced into the chamber B is around 100% ethylene oxide, the percent by volume of ethylene oxide and other gases may be present in the chamber B within the following ranges: ethylene oxide between about 2% to about 50%; steam—between about 2% to about 20% and air—between about 0% to about 78%.

When the sterilizing gas introduced into the chamber B is a combination of ethylene oxide and a carrier gas, the percent by volume of these gases and other gases may be present the chamber B within the following ranges: ethylene oxide—between about 2% to about 25%; carrier gas between about 25% to about 96%; steam—between about 2% to about 20%; and air—between about 0% to about 30%. When the carrier gas is nitrogen, the percent by volume thereof in the chamber B may be from between about 25% to about 96%, and particularly from between about 60% to about 90%, and more particularly from between about 65% to about 85% and still more particularly from between about 70% to about 80%. When the carrier gas is carbon dioxide, the percent by volume thereof in the chamber B may be from between about 25% to about 96% and particularly from between about 60% to about 90% and more particularly from between about 75% to about 85% and still more particularly from between about 70% to about 80%.

FIG. 4E illustrates the sealing sequence. In this sequence, the supply of gases to the nozzle 446 is removed and the gases previously introduced into the chamber A are captured therein. The heat sealer 436 is positioned by the extension of the pistons 435 such that the lip 442 of the seal die 436 contacts the upper surface of the top web 416. Upon the application of sufficient pressure and temperature by the seal die 436 upon the top web 416 and the passage of sufficient time, the top and bottom webs 416 and 412, respectively, are secured together, such as by bonding or fusing, thus closing the housing 417. Ventilation of the chambers A and C via ports 420 and 428, respectively, continues during this time so that residual sterilizing gas may be removed from these chambers while the housing 417 is being closed within the closed sealing station 410.

Figure 4F:
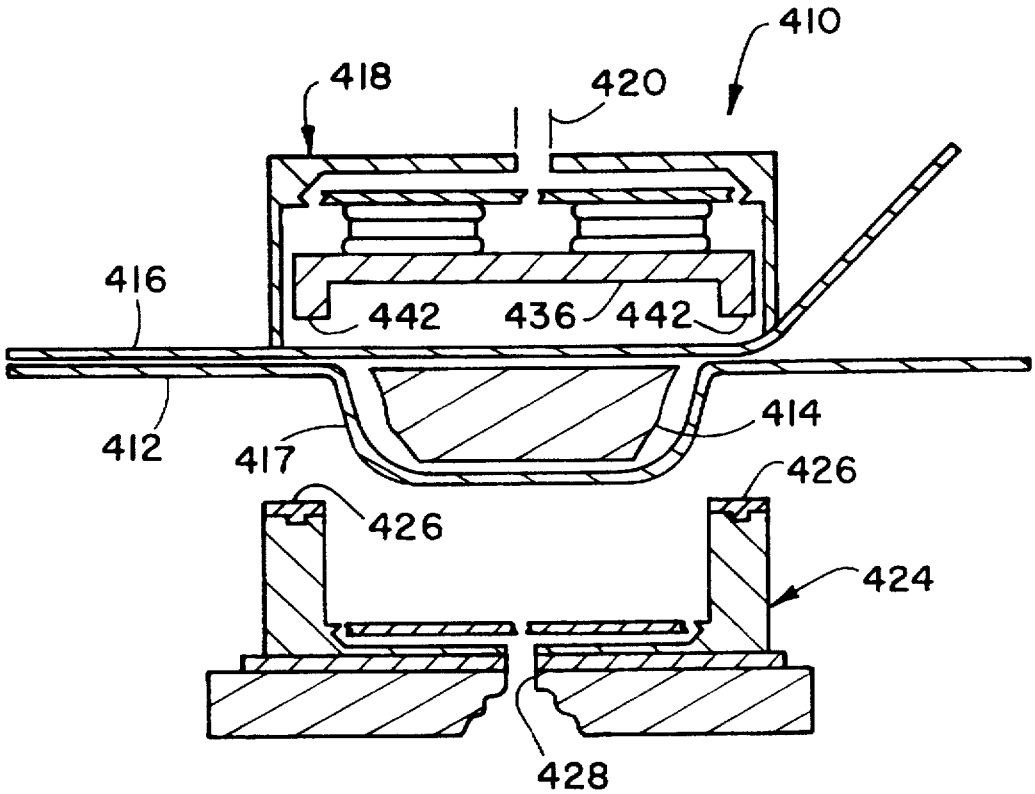

Referring now to FIG. 4F, the heat sealer 436 has been raised by retracting the pistons 435 (not shown) such that lips 442 are spaced a distance from the top web 416. The seal die has been retracted such that the T-rubbers 426 are spaced a distance from the bottom web 412 and the gas nozzle has been removed for clarity of illustration. The closed housing 417 is now advanced by the conveyer system to the casing/palletizing station for degassing. Generally, simultaneously with the advancement of the closed housing 417, another housing supporting an article enters the sealing station 410 and the sealing station sequence is repeated.

The present invention is further described by the examples which follow. Such examples, however, are not to be construed as limiting in any way either the spirit or the scope of the present invention.

EXAMPLE 1

Procedure: An article to be sterilized was placed into an open, preformed bottom web. The article was a folded disposable surgical gown. The gown fabric was a three-layer nonwoven polypropylene material known as SMS. SMS is an acronym for Spunbond, Meltblown, Spunbond, the process by which the three layers are constructed and then laminated together. See for example, U.S. Pat. No. 4,041,203 to Brock: et al.

Spordex™ spore strips, a product of AMSCO American Sterilizer Co. Erie, Pa., were placed at various locations within the housing and the folded article. Spordex™ spore strips are biological indicators for monitoring dry heat or ethylene oxide sterilization processes. For the test data reported in Tables I–V, the spore strips were placed in three locations within the housing. One spore strip was placed on the top of the folded gown, a second spore strip was placed inside the folded gown and the third spore strip was placed between the gown and the bottom of the housing.

For the test data reported in Tables VI–VIII, the spore strips were placed in five locations within the housing. One spore strip was placed on the top of the folded gown, a second spore strip was placed between the folded gown and the bottom of the housing, a third spore strip was placed in the gown at a location half way between the first and second spore strips, a fourth spore strip was place in the gown at a location half way between the first and third spore strips and a fifth spore strip was placed half way between the third and second spore strips.

A positive sign, "+", is used to indicate biological activity on the spore strip, or a non-sterile condition. A negative sign, "–", is used to indicate biological inactivity or a sterile condition. For the article to be considered sterilized, the analysis of all the spore strips within a housing should indicate biological inactivity.

The housing, including contents, was placed into a Multivac AGW chamber machine, a product of Sepp Haggenmuller KG, 8941 Wolferschwenden, Germany. The open end of the housing was placed between the heat sealer bars within the chamber machine. The lid of the chamber machine was closed and at least some of the gases within the chamber and the housing were evacuated.

Steam, at between 45 psi to 65 psi was first introduced into the closed chamber machine. The sterilizing gas, a mixture of either ethylene oxide/carbon dioxide or ethylene oxide/nitrogen, at a pressure of between 35 psi and 60 psi, was then introduced into the closed chamber machine. After the passage of sufficient period of time for the introduced gases to become equally distributed within the closed chamber machine and the open housing, the housing was closed by heat sealing.

The chamber machine was then flushed with air. Once the atmospheric pressure was reached within the chamber machine, the lid of the chamber machine was opened and the closed housing removed. The closed housing was then placed into a ventilated oven which was maintained at between 130° F. to 140° F. and degassed from between 4 to 24 hours.

For Tables I, II, IV–IX the spore strips were analyzed immediately after the degassing period. For Table III, the spore strips were analyzed approximately 3 days after the degassing period.

RESULTS

Tables I–V report the test parameters and sterility results for an ethylene oxide/carbon dioxide sterilizing gas mixture. With reference to Tables I and II, sterility was generally achieved in the shortest time, after about 6 hours of degassing, when the pressure at the conclusion of the introduction of ethylene oxide was at least 500 millibars of mercury and percent of ethylene oxide at the conclusion of the introduction thereof into the housing was about 7.3% to about 7.4%, or about 58 mg/l of ethylene oxide. Sterility was also achieved at lower concentrations of ethylene oxide (about 6.9% of ethylene oxide at the conclusion of the introduction thereof into the housing or about 55 mg/l of ethylene oxide) when the pressure at the conclusion of the introduction of the ethylene oxide was at least 500 millibars of mercury and the degassing period was about 16 hours.

With reference to Table III, sterility was achieved by at least the 7$^{th}$ day following degassing. In packages 1–3 and 5–9, the percent of ethylene oxide present at the conclusion of the introduction thereof into the housing was between about 6.8% to about 7.8%, or between about 60 mg/l to about 81 mg/l of ethylene oxide. The non-sterile condition of package 4 after this period of time, in all probability, was due to a lack of complete closure of the package by heat sealing.

Referring now to Tables IV and V, sterility was achieved at between about 7.5 hours to about 9.5 hours of degassing wherein the vacuum level within the housing was at least 60 millibars of mercury and the percent of ethylene oxide present at the conclusion of the introduction thereof into the housing was between about 6.9% to about 7.3% or between about 71 mg/l to about 81 mg/l.

TABLE I

| Package Numbers | Vacuum Level | Steam Level | Gas Mixture | Gas Level | Deqas Time | Test Results |
|---|---|---|---|---|---|---|
| 1 | 30 mb | ⁻65 mb | 6.00% AIR<br>7.00% STEAM | 500 mb<br>Total | 6 Hours 25 Min. | Sterile |
| | | | 7.40% ETO<br>79.61% $CO_2$ | 58.8 mg/l<br>ETO | | |
| 2 | 30 mb | ⁻55 mb | 5.00% AIR<br>4.17% STEAM | 600 mb<br>Total | 6 Hours 5 Min. | Sterile |
| | | | 7.72% ETO<br>83.11% $CO_2$ | 73.7 mg/l<br>ETO | | |

Notes:
mb = millibars of Mercury vacuum/pressure
$CO_2$ = Carbon dioxide gas
ETO = Ethylene oxide gas
Package Composition = Starflex-C, 6.25 Thil/Phoenix EPPFF-B, paper-polylaminate
Gas Drum Mixture = 8.5% ETO/91.5% $CO_2$

TABLE II

| Package Numbers | Vacuum Level | Steam Level | Gas Mixture | Gas Level | Deqas Time | Test Results |
|---|---|---|---|---|---|---|
| 1 | 30 mb | ⁻68 mb | 6.00% AIR<br>7.60% STEAM | 500 mb<br>Total | 5 Hours 45 Min. | Sterile |
| | | | 7.34% ETO<br>79.06% $CO_2$ | 58.4 mg/l<br>ETO | | |
| 2 | 30 mb | ⁻67 mb | 5.00% AIR<br>6.17% STEAM | 600 mb<br>Total | 5 Hours 40 Min. | 2+/1− |
| | | | 7.55% ETO<br>81.28% $CO_2$ | 72.0 mg/l<br>ETO | | |
| 3 | 30 mb | ⁻50 mb | 4.29% AIR<br>2.86% STEAM | 700 mb<br>Total | 5 Hours 30 Min. | 1+/2− |
| | | | 7.89% ETO<br>84.96% $CO_2$ | 87.9 mg/l<br>ETO | | |
| 4 | 30 mb | ⁻84 mb | 4.00% AIR<br>7.20% STEAM | 750 mb<br>Total | 5 Hours 25 Min. | Sterile |
| | | | 7.55% ETO<br>81.25% $CO_2$ | 90.0 mg/l<br>ETO | | |
| 5 | 30 mb | ⁻88 mb | 6.00% AIR<br>11.60% STEAM | 500 mb<br>Total | 5 Hours 17 Min. | 2+/1− |
| | | | 7.00% ETO<br>75.40% $CO_2$ | 55.7 mg/l<br>ETO | | |
| 6 | 30 mb | ⁻88 mb | 5.00% AIR<br>9.67% STEAM | 600 mb<br>Total | 5 Hours 11 Min. | 2+/1− |
| | | | 7.25% ETO<br>78.08% $CO_2$ | 69.2 mg/l<br>ETO | | |
| 7 | 30 mb | ⁻98 mb | 4.29% AIR<br>9.71% STEAM | 700 mb<br>Total | 5 Hours 5 Min. | 2+/1− |
| | | | 7.31% ETO | 81.4 mg/l | | |

TABLE II-continued

| Package Numbers | Vacuum Level | Steam Level | Gas Mixture | Gas Level | Deqas Time | Test Results |
|---|---|---|---|---|---|---|
| 8 | 30 mb | ⁻92 mb | 78.69% $CO_2$<br>4.00% AIR<br>8.27% STEAM | ETO<br>750 mb<br>Total | 5 Hours 5 Min. | 3+ |
| 9 | 30 mb | ⁻81 mb | 7.46% ETO<br>80.28% $CO_2$<br>6.00% AIR<br>10.20% STEAM | 88.9 mg/l<br>ETO<br>500 mb<br>Total | 16 Hours 20 Min. | Sterile |
| 10 | 30 mb | ⁻86 mb | 7.12% ETO<br>76.68% $CO_2$<br>5.00% AIR<br>9.33% STEAM | 56.6 mg/l<br>ETO<br>600 mb<br>Total | 16 Hours 15 Min. | Sterile |
| 11 | 30 mb | ⁻90 mb | 7.28% ETO<br>78.39% $CO_2$<br>4.29% AIR<br>8.57% STEAM | 69.5 mg/l<br>ETO<br>700 mb<br>Total | 16 Hours 14 Min. | Sterile |
| 12 | 30 mb | ⁻89 mb | 7.41% ETO<br>79.74% $CO_2$<br>4.00% AIR<br>7.87% STEAM | 82.5 mg/l<br>ETO<br>750 mb<br>Total | 16 Hours 11 Min. | Sterile |
| 13 | 40 mb | ⁻95 mb | 7.49% ETO<br>80.64% $CO_2$<br>8.00% AIR<br>11.00% STEAM | 89.3 mg/l<br>ETO<br>500 mb<br>Total | 16 Hours 00 Min. | Sterile |
| 14 | 44 mb | ⁻95 mb | 6.89% ETO<br>74.12% $CO_2$<br>7.33% AIR<br>8.50% STEAM | 54.7 mg/l<br>ETO<br>600 mb<br>Total | 15 Hours 53 Min. | Sterile |
| 15 | 41 mb | ⁻92 mb | 7.15% ETO<br>77.01% $CO_2$<br>5.86% AIR<br>7.29% STEAM | 68.3 mg/l<br>ETO<br>700 mb<br>Total | 15 Hours 50 Min. | Sterile |
| 16 | 41 mb | ⁻92 mb | 7.38% ETO<br>79.47% $CO_2$<br>5.47% AIR<br>6.80% STEAM | 82.2 mg/l<br>ETO<br>750 mb<br>Total | 15 Hours 45 Min. | Sterile |
| 17<br>(+ Control) | 30 mb | ⁻80 mb | 7.46% ETO<br>80.28% $CO_2$<br>90.00% AIR<br>10.00% STEAM | 88.9 mg/l<br>ETO<br>500 mb<br>Total | 16 Hours 5 Min. | 3+ |
| | | | 0% ETO<br>0% $CO_2$ | 0 mg/l<br>ETO | | |

Notes:
mb = millibars of Mercury vacuum/pressure
$CO_2$ = Carbon dioxide gas
ETO = Ethylene oxide gas
Package Composition = Starflex-C, 6.25 mil/Phoenix EPPFF-B, paper-poly laminate
Gas Drum Mixture = 8.5% ETO/91.5% $CO_2$

TABLE III

| Package Numbers | Vacuum Level | Air % | Steam Level | Steam % | Gas(mb) Mixture | ETO % | $CO_2$ % | ETO (mg/l) | Degas Time | Sterility Test After 7 days |
|---|---|---|---|---|---|---|---|---|---|---|
| 1 | 90 mb | 16.07 | ⁻110 mb | 3.57 | 560 | 6.83 | 73.53 | 60.83 | 4.5 Hours | 3(−)/0(+) |
| 2 | 90 mb | 13.85 | ⁻125 mb | 5.38 | 650 | 6.87 | 73.90 | 70.97 | 5.5 Hours | 3(−)/0(+) |
| 3 | 90 mb | 12.16 | ⁻140 mb | 6.76 | 740 | 6.89 | 74.19 | 81.10 | 6.5 Hours | 3(−)/0(+) |
| 4 | 60 mb | 9.92 | ⁻80 mb | 3.31 | 605 | 7.38 | 79.40 | 70.97 | 6.5 Hours | 0(−)/3(+) |
| 5 | 60 mb | 8.63 | ⁻95 mb | 5.04 | 695 | 7.34 | 78.99 | 81.10 | 4.5 Hours | 3(−)/0(+) |
| 6 | 60 mb | 10.71 | ⁻110 mb | 8.93 | 560 | 6.83 | 73.53 | 60.83 | 5.5 Hours | 3(−)/0(+) |
| 7 | 30 mb | 4.62 | ⁻50 mb | 3.08 | 650 | 7.85 | 84.46 | 81.10 | 5.5 Hours | 3(−)/0(+) |
| 8 | 30 mb | 5.83 | ⁻65 mb | 6.80 | 515 | 7.43 | 79.95 | 60.83 | 6.5 Hours | 3(−)/0(+) |
| 9 | 30 mb | 4.96 | ⁻80 mb | 8.26 | 605 | 7.38 | 79.40 | 70.97 | 4.5 Hours | 3(−)/0(+) |

TABLE III-continued

| Package Numbers | Vacuum Level | Air % | Steam Level | Steam % | Gas(mb) Mixture | ETO % | $CO_2$ % | ETO (mg/l) | Degas Time | Sterility Test After 7 days |
|---|---|---|---|---|---|---|---|---|---|---|
| 10 | 30 mb | 4.05 | ⁻80 mb | 6.76 | 740 | 0.00 | 89.19 | 0 | 5.4 Hours | 0(−)/3(+)* |
| 11 | 30 mb | 4.05 | ⁻80 mb | 6.76 | 740 | 0.00 | 89.19 | 0 | 5.4 Hours | 0(−)/3(+)* |

*$CO_2$ only no ETO

TABLE IV

| Package Numbers | Vacuum Level | Air % | Steam Level | Steam % | Gas(mb) Mixture | ETO % | $CO_2$ % | ETO (mg/l) | Degas Time | Sterility Test After 7 days |
|---|---|---|---|---|---|---|---|---|---|---|
| 1 | 90 mb | 16.07 | ⁻110 mb | 3.57 | 560 | 6.83 | 73.53 | 60.83 | 7.5 Hours | 0(−)/3(+) |
| 2 | 90 mb | 13.85 | ⁻125 mb | 5.38 | 650 | 6.87 | 73.90 | 70.97 | 8.5 Hours | 2(−)/1(+) |
| 3 | 90 mb | 12.16 | ⁻140 mb | 6.76 | 740 | 6.89 | 74.19 | 81.10 | 9.5 Hours | 3(−)/0(+) |
| 4 | 60 mb | 9.92 | ⁻80 mb | 3.31 | 605 | 7.38 | 79.40 | 70.97 | 9.5 Hours | 3(−)/0(+) |
| 5 | 60 mb | 8.63 | ⁻95 mb | 5.04 | 695 | 7.34 | 78.99 | 81.10 | 7.5 Hours | 3(−)/0(+) |
| 6 | 60 mb | 10.71 | ⁻110 mb | 8.93 | 560 | 6.83 | 73.53 | 60.83 | 8.5 Hours | 2(−)/1(+) |
| 7 | 30 mb | 4.62 | ⁻50 mb | 3.08 | 650 | 7.85 | 84.46 | 81.10 | 8.5Hours | 3(−)/0(+) |
| 8 | 30 mb | 5.83 | ⁻65 mb | 6.80 | 515 | 7.43 | 79.95 | 60.83 | 9.5 Hours | 2(−)/1(+) |
| 9 | 30 mb | 4.96 | ⁻80 mb | 8.26 | 605 | 7.38 | 79.40 | 70.97 | 7.5 Hours | 0(−)/3(+) |

TABLE V

| Package Numbers | Vacuum Level | Air % | Steam Level | Steam % | Gas(mb) Mixture | ETO % | $CO_2$ % | ETO (mg/l) | Degas Time | Sterility Test After 7 days |
|---|---|---|---|---|---|---|---|---|---|---|
| 1 | 90 mb | 16.07 | ⁻110 mb | 3.57 | 560 | 6.83 | 73.53 | 60.83 | 4.5 Hours | 1(−)/2(+) |
| 2 | 90 mb | 13.85 | ⁻125 mb | 5.38 | 650 | 6.87 | 73.90 | 70.97 | 5.5 Hours | 1(−)/2(+) |
| 3 | 90 mb | 12.16 | ⁻140 mb | 6.76 | 740 | 6.89 | 74.19 | 81.10 | 6.5 Hours | 1(−)/2(+) |
| 4 | 60 mb | 9.92 | ⁻80 mb | 3.31 | 605 | 7.38 | 79.40 | 70.97 | 6.5 Hours | 0(−)/3(+) |
| 5 | 60 mb | 8.63 | ⁻95 mb | 5.04 | 695 | 7.34 | 78.99 | 81.10 | 4.5 Hours | 1(−)/2(+) |
| 6 | 60 mb | 10.71 | ⁻110 mb | 8.93 | 560 | 6.83 | 73.53 | 60.83 | 5.5 Hours | 0(−)/3(+) |
| 7 | 30 mb | 4.62 | ⁻50 mb | 3.08 | 650 | 7.85 | 84.46 | 81.10 | 5.5 Hours | 0(−)/3(+) |
| 8 | 30 mb | 5.83 | ⁻65 mb | 6.80 | 515 | 7.43 | 79.95 | 60.83 | 6.5 Hours | 0(−)/3(+) |
| 9 | 30 mb | 4.96 | ⁻80 mb | 8.26 | 605 | 7.38 | 79.40 | 70.97 | 4.5 Hours | 1(−)/2(+) |

Tables VI–IX report the test parameters and sterility results for an ethylene oxide/nitrogen sterilizing gas mixture. With reference to Tables VI–VIII, sterility was generally achieved after degassing for about 5 hours from the introduction of ethylene oxide when the concentration of ethylene oxide in the housing at the conclusion of the introduction thereof was about 13.7%. At concentrations of ethylene oxide of about 11.4% in the housing at the conclusion of the introduction thereof, sterilization occurred after degassing for about 12 hours from the introduction of ethylene oxide into the housing. Referring now to Table IX, and particularly to package numbers 11 and 12, at concentrations of ethylene oxide of about 3.9%, sterility was generally achieved after degassing for about 22 hours from the introduction of ethylene oxide into the housing.

TABLE VI

| Package Numbers | Vacuum Level | Steam Level | Gas Mixture | Gas Level | Degas Time | Test Results |
|---|---|---|---|---|---|---|
| 1 | 30 mb | ⁻80 mb | 11.43% ETO<br>77.14% $N_2$<br>7.14% STEAM<br>4.29% AIR | 320 mb<br>ETO/$N_2$<br>300 mb<br>$N_2$ | 24 Hours | Sterile<br><br>5– Spore<br>Strips |
| 2 | 30 mb | ⁻80 mb | 11.43% ETO<br>77.14% $N_2$<br>7.14% STEAM<br>4.29% AIR | 320 mb<br>ETO/$N_2$<br>300 mb<br>$N_2$ | 12 Hours | Sterile<br><br>5– Spore<br>Strips |
| 3 | 30 mb | ⁻50 mb | 11.43% ETO | 320 mb | 6 Hours | Non Sterile |

TABLE VI-continued

| Package Numbers | Vacuum Level | Steam Level | Gas Mixture | Gas Level | Degas Time | Test Results |
|---|---|---|---|---|---|---|
| | | | 81.43% $N_2$ | ETO/$N_2$ | | |
| | | | 2.86% STEAM | 330 mb | | 4+/1– Spore |
| | | | 4.29% AIR | $N_2$ | | Strips |
| 4 | 30 mb | ⁻50 mb | 11.43% ETO | 320 mb | 12 Hours | Sterile |
| | | | 81.43% $N_2$ | ETO/$N_2$ | | |
| | | | 2.86% STEAM | 330 mb | | 5– Spore |
| | | | 4.29% AIR | $N_2$ | | Strips |
| 5 | 30 mb | ⁻50 mb | 11.43% ETO | 320 MB | 24 Hours | Sterile |
| | | | 81.43% $N_2$ | ETO/$N_2$ | | |
| | | | 2.86% STEAM | 330 mb | | 5– Spore |
| | | | 4.29% AIR | $N_2$ | | Strips |

Notes:
mb = millibars of Mercury vacuum/pressure
$N_2$ = Nitrogen gas
ETO = Ethylene Oxide Gas
Package Composition = Starflex-C, 6.25 mil/Phoenix EPPFF-B, paper-poly laminate
Gas Drum Mixture = 25.0% ETO/75.0% $N_2$
Packages #1–2, 88471-60; #3–5, 88726-60

TABLE VII

| Package Numbers | Vacuum Level | Steam Level | Gas Mixture | Gas Level | Degas Time | Test Results |
|---|---|---|---|---|---|---|
| 1 | 30 mb | ⁻80 mb | 13.87% ETO | 600 mb | 8 Hours | Sterile |
| | | | 72.80% $N_2$ | | | |
| | | | 8.33% STEAM | | | |
| | | | 5.00% AIR | | | |
| 2 | 30 mb | ⁻80 mb | 13.75% ETO | 600 mb | 9 Hours | Non Sterile |
| | | | 72.91% $N_2$ | | | |
| | | | 8.33% STEAM | | | 1+/4– Spore |
| | | | 5.00% AIR | | | Strips |
| 3 | 30 mb | ⁻80 mb | 13.75% ETO | 600 mb | 10 Hours | Sterile |
| | | | 72.91% $N_2$ | | | |
| | | | 8.33% STEAM | | | |
| | | | 5.00% AIR | | | |
| 4 | 30 mb | ⁻80 mb | 13.75% ETO | 600 mb | 11 Hours | Sterile |
| | | | 72.91% $N_2$ | | | |
| | | | 8.33% STEAM | | | |
| | | | 5.00% AIR | | | |
| 5 | 30 mb | ⁻80 mb | 13.75% ETO | 600 mb | 12 Hours | Sterile |
| | | | 72.91% $N_2$ | | | |
| | | | 8.33% STEAM | | | |
| | | | 5.00% AIR | | | |

Notes:
mb = millibars of Mercury vacuum/pressure
$N_2$ = Nitrogen gas
ETO = Ethylene Oxide Gas
Package Composition = Starflex-C, 6.25 mil/Phoenix EPPFF-B, paper-poly laminate
Gas Drum Mixture = 15.87% ETO/84.13% $N_2$

TABLE VIII

| Package Numbers | Vacuum Level | Steam Level | Gas Mixture | Gas Level | Degas Time | Test Results |
|---|---|---|---|---|---|---|
| 1–3 | 30 mb | ⁻80 mb | 13.87% ETO | 600 mb | 4 Hours | Non Sterile |
| | | | 72.80% $N_2$ | | | |
| | | | 8.33% STEAM | | | 2+/3– Spore |
| | | | 5.00% AIR | | | Strips |
| 4–6 | 30 mb | ⁻80 mb | 13.75% ETO | 600 mb | 5 Hours | Sterile |
| | | | 72.91% $N_2$ | | | |
| | | | 8.33% STEAM | | | |

TABLE VIII-continued

| Package Numbers | Vacuum Level | Steam Level | Gas Mixture | Gas Level | Degas Time | Test Results |
|---|---|---|---|---|---|---|
| 7–9 | 30 mb | ⁻80 mb | 5.00% AIR<br>13.75% ETO<br>72.91% $N_2$<br>8.33% STEAM | 600 mb | 6 Hours | Sterile |
| 10–11 | 30 mb | ⁻80 mb | 5.00% AIR<br>13.75% ETO<br>72.91% $N_2$<br>8.33% STEAM | 600 mb | 7 Hours | Sterile |
| 12–15 | 30 mb | ⁻80 mb | 5.00% AIR<br>13.75% ETO<br>72.91% $N_2$<br>8.33% STEAM<br>5.00% AIR | 600 mb | 8 Hours | Sterile |

Notes:
mb = millibars of Mercury vacuum/pressure
$N_2$ = Nitrogen gas
ETO = Ethylene Oxide Gas
Package Composition = Starflex-C, 6.25 mil/Phoenix EPPFF-B, paper-poly laminate
Gas Drum Mixtures = Package numbers 1–3, 16% ETO/84% $N_2$, all others, 15.87% ETO/84.13% $N_2$

TABLE IX

| Package Numbers | Vacuum Level | Air % | Steam Level | Steam % | Gas(mb) Mixture | ETO % | $N_2$ % | ETO (mg/l) | Degas Time | Sterility Test |
|---|---|---|---|---|---|---|---|---|---|---|
| 1 | 30 mb | 4.29 | ⁻50 mb | 7.14 | 620 | 14.35 | 74.22 | 159.73 | 2.00 Hours | 2(−)/1(+) |
| 2 | 30 mb | 4.29 | ⁻50 mb | 7.14 | 620 | 14.35 | 74.22 | 159.73 | 2.20 Hours | 1(−)/2(+) |
| 3 | 30 mb | 4.29 | ⁻50 mb | 7.14 | 620 | 14.35 | 74.22 | 159.73 | 7.40 Hours | 3(−)/0(+) |
| 4 | 30 mb | 4.29 | ⁻50 mb | 7.14 | 620 | 14.35 | 74.22 | 159.73 | 7.45 Hours | 3(−)/0(+) |
| 5 | 30 mb | 4.29 | ⁻50 mb | 7.14 | 620 | 14.35 | 74.22 | 159.73 | 22.03 Hours | 3(−)/0(+) |
| 6 | 30 mb | 4.29 | ⁻50 mb | 7.14 | 620 | 14.35 | 74.22 | 159.73 | 22.24 Hours | 3(−)/0(+) |
| 7 | 30 mb | 4.29 | ⁻50 mb | 7.14 | 620 | 3.90 | 84.67 | 43.38 | 2.00 Hours | 0(−)/3(+) |
| 8 | 30 mb | 4.29 | ⁻50 mb | 7.14 | 620 | 3.90 | 84.67 | 43.38 | 4.00 Hours | 0(−)/3(+) |
| 9 | 30 mb | 4.29 | ⁻50 mb | 7.14 | 620 | 3.90 | 84.67 | 43.38 | 7.21 Hours | 0(−)/3(+) |
| 10 | 30 mb | 4.29 | ⁻50 mb | 7.14 | 620 | 3.90 | 84.67 | 43.38 | 7.20 Hours | 0(−)/3(+) |
| 11 | 30 mb | 4.29 | ⁻50 mb | 7.14 | 620 | 3.90 | 84.67 | 43.38 | 22.00 Hours | 3(−)/0(+) |
| 12 | 30 mb | 4.29 | ⁻50 mb | 7.14 | 620 | 3.90 | 84.67 | 43.38 | 21.50 Hours | 3(−)/0(+) |
| 13 | 30 mb | 4.29 | ⁻50 mb | 7.14 | 620 | 3.90 | 84.67 | 43.38 | 2.50 Hours | 0(−)/3(+) |
| 14 | 30 mb | 4.29 | ⁻50 mb | 7.14 | 620 | 3.90 | 84.67 | 43.38 | 3.22 Hours | 0(−)/3(+) |
| 15 | 30 mb | 4.29 | ⁻50 mb | 7.14 | 620 | 3.90 | 84.67 | 43.38 | 5.22 Hours | 0(−)/3(+) |
| 16 | 30 mb | 4.29 | ⁻50 mb | 7.14 | 620 | 3.90 | 84.67 | 43.38 | 19.20 Hours | 2(−)/1(+) |
| 17 | 30 mb | 4.29 | ⁻50 mb | 7.14 | 620 | 3.90 | 84.67 | 43.38 | 19.35 Hours | 2(−)/1(+) |
| 18 | 30 mb | 4.29 | ⁻50 mb | 7.14 | 620 | 3.90 | 84.67 | 43.38 | 19.44 Hours | 2(−)/1(+) |
| 19 | 30 mb | 10.00 | ⁻50 mb | 16.67 | 220 | 11.00 | 62.33 | 52.48 | 2.07 Hours | 0(−)/3(+) |
| 20 | 30 mb | 10.00 | ⁻50 mb | 16.67 | 220 | 11.00 | 62.33 | 52.48 | 4.43 Hours | 1(−)/2(+) |
| 21 | 30 mb | 10.00 | ⁻50 mb | 16.67 | 220 | 11.00 | 62.33 | 52.48 | 4.45 Hours | 0(−)/3(+) |
| 22 | 30 mb | 10.00 | ⁻50 mb | 16.67 | 220 | 11.00 | 62.33 | 52.48 | 18.38 Hours | 3(−)/0(+) |
| 23 | 30 mb | 10.00 | ⁻50 mb | 16.67 | 220 | 11.00 | 62.33 | 52.48 | 18.39 Hours | 3(−)/0(+) |
| 24 | 30 mb | 10.00 | ⁻50 mb | 16.67 | 220 | 11.00 | 62.33 | 52.48 | 18.51 Hours | 3(−)/0(+) |
| 25 | 30 mb | 10.00 | ⁻50 mb | 16.67 | 220 | 11.00 | 62.33 | 52.48 | 2.00 Hours | 0(−)/3(+) |
| 26 | 30 mb | 10.00 | ⁻50 mb | 16.67 | 220 | 11.00 | 62.33 | 52.48 | 4.02 Hours | 0(−)/3(+) |
| 27 | 30 mb | 10.00 | ⁻50 mb | 16.67 | 220 | 11.00 | 62.33 | 52.48 | 18.03 Hours | 3(−)/0(+) |
| 28 | 30 mb | 10.00 | ⁻50 mb | 16.67 | 220 | 11.00 | 62.33 | 52.48 | 18.04 Hours | 3(−)/0(+) |
| 29 | 30 mb | 10.00 | ⁻50 mb | 16.67 | 220 | 11.00 | 62.33 | 52.48 | 18.10 Hours | 3(−)/0(+) |
| 30 | 30 mb | 10.00 | ⁻50 mb | 16.67 | 220 | 11.00 | 62.33 | 52.48 | 18.11 Hours | 3(−)/0(+) |

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

What is claimed is:

1. A method of packing an article comprising:

placing the article in a housing;

evacuating at least some of the gases in the housing;

introducing steam and a sterilizing gas into the evacuated housing; and closing the housing, wherein the concentration of sterilizing gas at the conclusion of the introducing step is about 10% or less by volume of the housing.

2. The method of claim 1 further including the step of partially closing the housing prior to the introducing step.

3. The method of claim 1 wherein the sterilizing gas is a mixture of ethylene oxide and a carrier gas.

4. The method of claim 3 wherein the percent by volume of ethylene oxide in the housing at the conclusion of the introducing step is at least about 2%.

5. The method of claim 1 wherein the steam and the sterilizing gas are introduced simultaneously into the housing.

6. The method of claim 1 wherein the pressure of the steam at the point of introduction into the housing is between about 15 psi to about 80 psi.

7. The method of claim 1 further including the step of heating the closed housing to between about 120° Fahrenheit to about 140° Fahrenheit for at least about four hours.

8. A method of packing an article comprising:

placing the article in a housing;

partially closing the housing;

providing a gas conduit for accessing gases within the housing;

evacuating, through the gas conduit, at least some of the gases within the housing;

introducing, through the gas conduit, steam and a sterilizing gas into the evacuated housing;

removing the gas conduit from the housing; and closing the housing, wherein the concentration of sterilizing gas at the conclusion of the introducing step is about 10% or less by volume of the housing.

9. The method of claim 8 wherein the article is a nonwoven article.

10. The method of claim 8 wherein the pressure within the housing at the conclusion of the evacuating step is between about 30 to about 100 millibars of mercury.

11. The method of claim 8 wherein the steam and the sterilizing gas are simultaneously introduced into the housing.

12. The method of claim 8 wherein the sterilizing gas is a gaseous mixture of ethylene oxide and at least one carrier gas.

13. The method of claim 12 wherein the percent, by volume, of ethylene oxide present in the housing at the conclusion of the introducing step is at least about 2%.

14. A method of sterilizing an article comprising:

placing the article into a formed bottom web;

forming a housing by overlying the formed bottom web with a top web;

partially closing the housing;

positioning a gas nozzle within the housing;

evacuating, through the gas nozzle, at least some of the gases within the housing;

introducing, through the gas nozzle, steam and a sterilizing gas into the evacuated housing;

removing the gas nozzle and closing the housing; and heating the closed housing to between about 120° Fahrenheit to about 140° Fahrenheit for at least about four hours, wherein the concentration of sterilizing gas at the conclusion of the introducing step is about 10% or less by volume of the housing.

15. The method of claim 14 wherein steam and the sterilizing gas are introduced simultaneously.

16. The method of claim 14 wherein the sterilizing gas is a mixture of ethylene oxide and a carrier gas, wherein the carrier gas is selected from the group consisting of carbon dioxide and nitrogen.

17. The method of claim 16 wherein the percent, by volume, of ethylene oxide present in the housing at the conclusion of the introducing step is at least about 2%.

18. The method of claim 16 wherein the percent, by volume, of ethylene oxide present in the housing at the conclusion of the introducing step is between about 4% to about 10%.

19. A method of packing an article comprising:

placing the article in a housing;

partially closing the housing containing the article;

providing a gas conduit for accessing gases within the housing containing the article;

evacuating, through the gas conduit, at least some of the gases within the housing containing the article;

introducing, through the gas conduit, steam and a sterilizing gas into the evacuated housing; and closing the sterilizing gas containing housing, wherein the concentration of sterilizing gas at the conclusion of the introducing step is about 10% or less by volume of the housing.

20. The method of claim 19 wherein the article is a nonwoven article.

21. The method of claim 19 wherein the pressure within the housing at the conclusion of the evacuating step is between about 30 to about 100 millibars of mercury.

22. The method of claim 19 wherein the steam and the sterilizing gas are simultaneously introduced into the housing.

23. The method of claim 19 wherein the sterilizing gas is a gaseous mixture of ethylene oxide and at least one carrier gas.

24. The method of claim 23 wherein the percent, by volume, of ethylene oxide present in the housing at the conclusion of the introducing step is at least about 2%.

25. A method of sterilizing an article comprising:

placing the article into a formed bottom web;

forming a housing by overlying the formed bottom web containing the article with a top web;

partially closing the housing containing the article;

positioning a gas nozzle within the housing containing the article;

evacuating, through the gas nozzle, at least some of the gases within the housing containing the article;

introducing, through the gas nozzle, steam and a sterilizing gas into the evacuated housing;

removing the gas nozzle and closing the sterilizing gas containing housing; and heating the closed housing containing the sterilizing gas, wherein the concentration of sterilizing gas at the conclusion of the introducing step is about 10% or less by volume of the housing.

26. The method of claim 25 wherein steam and the sterilizing gas are introduced simultaneously.

27. The method of claim 25 wherein the sterilizing gas is a mixture of ethylene oxide and a carrier gas, wherein the carrier gas is a member selected from the group consisting of carbon dioxide and nitrogen.

28. The method of claim 27 wherein the percent, by volume, of ethylene oxide present in the housing at the conclusion of the introducing step is at least about 2%.

29. The method of claim 27 wherein the percent, by volume, of ethylene oxide present in the housing at the conclusion of the introducing step is between about 4% to about 10%.

30. The method of claim 25 wherein the housing is heated to between about 120° Fahrenheit to about 140° Fahrenheit for at least about four hours.

31. The method of claim 27 wherein the percent, by volume, of ethylene oxide present in the housing at the conclusion of the introducing step is at least about 4%.

32. A method of sterilizing an article comprising:

placing the article into a formed bottom web;

forming a housing by overlying the formed bottom web containing the article with a top web;

partially closing the housing containing the article;

positioning a gas nozzle within the housing containing the article;

evacuating, through the gas nozzle, at least some of the gases within the housing containing the article, wherein the pressure within the housing at the conclusion of the evacuation step is between about 30 to about 100 millibars of mercury;

introducing, through the gas nozzle, steam and a sterilizing gas into the evacuated housing, wherein the pressure within the housing at the conclusion of the introducing step is between 300 and 700 millibars of mercury and wherein the percent, by volume, of sterilizing gas present in the housing is at least 4%;

removing the gas nozzle and closing the sterilizing gas containing housing; and heating the closed housing containing the sterilizing gas to between about 120° Fahrenheit to about 140° Fahrenheit for at least about four hours, wherein the concentration of sterilizing gas at the conclusion of the introducing step is about 10% or less by volume of the housing.

33. A method of packing an article comprising:

placing the article in a housing;

evacuating at least some of the gases in the housing;

introducing steam into the evacuated housing;

introducing a sterilizing gas into the evacuated housing to effect sterilization of the article; and closing the housing, wherein the concentration of sterilizing gas at the conclusion of the introducing step is about 10% or less by volume of the housing.

34. The method of claim 1 wherein the concentration of sterilizing gas at the conclusion of the introducing step is about 8% by volume or less.

35. The method of claim 8 wherein the concentration of sterilizing gas at the conclusion of the introducing step is about 8% by volume or less.

36. The method of claim 33 wherein the concentration of sterilizing gas at the conclusion of the introducing step is about 8% by volume or less.

37. The method of claim 14 wherein the article is sterilized in 18 hours or less.

38. The method of claim 25 wherein the article is sterilized in 18 hours or less.

39. The method of claim 32 wherein the article is sterilized in 18 hours or less.

40. A method of packing an article comprising:

placing the article in a housing;

evacuating at least some of the gases in the housing;

introducing steam and a sterilizing gas into the evacuated housing; and closing the housing, wherein the concentration of sterilizing gas at the conclusion of the introducing step is about 20% or less by volume of the housing.

41. The method of claim 40 wherein the concentration of sterilizing gas is about 15% or less by volume of the housing.

42. The method of claim 40 wherein the concentration of sterilizing gas is about 5% or less by volume of the housing.

* * * * *